US010106369B2

(12) United States Patent
Makrinos

(10) Patent No.: US 10,106,369 B2
(45) Date of Patent: Oct. 23, 2018

(54) FLEXIBLE HELICAL CORD MANAGEMENT DEVICE

(71) Applicant: Rene N. Makrinos, Brooklyn, NY (US)

(72) Inventor: Rene N. Makrinos, Brooklyn, NY (US)

( * ) Notice: Subject to any disclaimer, the term of this patent is extended or adjusted under 35 U.S.C. 154(b) by 0 days.

(21) Appl. No.: 15/604,009

(22) Filed: May 24, 2017

(65) Prior Publication Data

US 2017/0341901 A1 Nov. 30, 2017

Related U.S. Application Data

(60) Provisional application No. 62/341,089, filed on May 25, 2016.

(51) Int. Cl.

| | |
|---|---|
| ***B65H 75/34*** | (2006.01) |
| ***B65H 57/00*** | (2006.01) |
| ***H01R 13/72*** | (2006.01) |
| ***B65H 75/36*** | (2006.01) |
| *B65H 75/00* | (2006.01) |
| *H01R 13/00* | (2006.01) |

(52) U.S. Cl.

CPC ..... *B65H 75/34* (2013.01); *B65H 57/00* (2013.01); *B65H 75/36* (2013.01); *H01R 13/72* (2013.01); *B65H 75/00* (2013.01); *B65H 2701/34* (2013.01); *B65H 2701/3919* (2013.01); *H01R 13/00* (2013.01); *Y10T 24/3916* (2015.01); *Y10T 24/3929* (2015.01); *Y10T 24/3998* (2015.01)

(58) Field of Classification Search

CPC ..... H01R 13/72; H01R 13/00; H01R 13/60; B65H 57/00; B65H 2701/34; B65H 75/00; Y10T 24/39; Y10T 24/398; Y10T 24/3916; Y10T 24/3929; Y10T 24/3998

See application file for complete search history.

(56) References Cited

U.S. PATENT DOCUMENTS

| | | | | |
|---|---|---|---|---|
| 751,093 A | | 2/1904 | Munro | |
| 1,458,261 A | | 7/1921 | Zink | |
| 1,698,027 A | * | 1/1929 | Seurynck | F16G 11/143 24/129 C |
| 1,888,875 A | * | 11/1932 | Long | F16B 45/02 24/115 N |
| 2,090,897 A | * | 8/1937 | Ray | F16G 15/04 24/116 R |

(Continued)

FOREIGN PATENT DOCUMENTS

WO 2012102512 8/2012

*Primary Examiner* — Robert Sandy
*Assistant Examiner* — Michael S Lee
(74) *Attorney, Agent, or Firm* — Gerald E. Hespos; Michael J. Porco; Adam Hotzoglou

(57) ABSTRACT

In one aspect of the present disclosure, a flexible cord management device is provided. The device includes a helical coil base, an s-loop, and a post. The base can be wrapped around at least a portion of a bundled cord. The s-loop includes a first loop and a second loop, where the first loop is coupled to a first end of the base. The first loop can be opened to receive a first end of the bundled cord, such that, the first end of the bundled cord is securely disposed through the first loop. The second loop is coupled to the first loop. The post extends from the first end of the base and can be inserted through the second loop to secure the first loop in a closed position and removed from the second loop to enable the first loop to achieve an open position.

20 Claims, 11 Drawing Sheets

(56) References Cited

U.S. PATENT DOCUMENTS 2,142,952 A * 1/1939 Rathgeber ..... D06F 53/04 24/131 R
2,478,184 A * 8/1949 Elliott ..... B60D 1/187 24/131 C
2,888,726 A * 6/1959 Smith, Sr. ..... H02G 7/056 174/79
2,931,133 A * 4/1960 Dodson ..... A63H 27/10 24/129 R
3,330,247 A * 7/1967 Gunderson ..... G09F 17/00 116/174
3,999,253 A * 12/1976 Hoadley ..... F16G 11/046 24/115 N
4,206,961 A 6/1980 Cifalde
4,236,282 A * 12/1980 Harvey, Jr. ..... F16G 11/046 24/131 C
4,413,381 A * 11/1983 Fidock ..... A01K 69/08 24/131 C
4,414,711 A 11/1983 Hubbard
4,792,254 A * 12/1988 Platten ..... E04H 17/10 174/158 F
5,141,192 A 8/1992 Adams
6,338,185 B1 1/2002 Solterbeck
D454,483 S * 3/2002 Wolf ..... D8/394
6,648,279 B1 11/2003 Malin et al.
6,668,583 B2 * 12/2003 O'Brien ..... A44C 5/18 24/128
6,848,270 B2 * 2/2005 White ..... A44C 3/008 24/131 C
7,712,696 B2 5/2010 Loh
7,739,775 B2 6/2010 Shimanski
8,590,823 B2 11/2013 Rothbaum et al.
8,793,842 B2 8/2014 Donovan et al.
2003/0097735 A1 * 5/2003 Shore ..... B65D 63/10 24/115 N
2003/0167605 A1 9/2003 Schultz
2013/0327900 A1 12/2013 Burgin

* cited by examiner

FLEXIBLE HELICAL CORD MANAGEMENT DEVICE

PRIORITY

The present application claims priority to U.S. Provisional Patent Application No. 62/341,089, filed May 25, 2016, entitled "FLEXIBLE HELICAL CORD MANAGEMENT DEVICE", the contents of which are hereby incorporated by reference in its entirety.

TECHNICAL FIELD

The present disclosure relates generally to cord management devices, and more particularly, to a flexible helical cord management device used to prevent cord entanglement.

BACKGROUND

With the proliferation of modern electrical and mobile devices (e.g., music players, mobile phones, tablets, laptops, etc.), the need for a user to own, carry, and maintain various cords and cables (e.g., head phones, charger cables, data transfer cables, extension cord etc.) that interface with these devices has increased. To compactly store and/or prevent entanglement of the various cords and cables users own, the cords or cables are often manually bundled or looped and stored in a user's pocket, bag, drawer, etc. In the bundled (and unsecured) state, the cables and cords are susceptible to becoming tangled, deformed, and/or crimped, especially while being carried or otherwise moved by a user. In general, the ordered state of a bundled cable or cord cannot usually be maintained in the absence of a cord management device.

Although some cord management devices exist, current solutions are often bulky, easily lost while not in use, malfunction in dirty environments, and are generally inefficient in use. For example, although devices, such as hook-and-loop fasteners, may be used to maintain the cords or cables in a bundled state, hook-and-loop fasteners, and other similar devices, have several disadvantages. While the user is using the cord or cable and the hook-and-loop fastener is not in use, the hook-and-loop fastener may easily be misplaced or lost. Furthermore, when the hook-and-loop is exposed to dirt, mud, dust, and other foreign elements, it may stop functioning properly.

Therefore, a need exists for a cord management device that addresses the cord user's needs in an efficient and unobtrusive manner.

SUMMARY

Flexible cord management devices are provided.

In one aspect of the present disclosure, the cord management devices includes: a helical coil base including a first end and a second end, the helical coil base configured to be wrapped around at least a portion of a bundled cord; and a first loop coupled to the first end of the helical coil base, the first loop defining a first aperture, the first loop configured to be opened to receive a first end of the bundled cord, such that, the first end of the bundled cord is securely disposed through the first aperture.

In another aspect of the present disclosure, the cord management device includes: a helical coil base including a first end and a second end, the helical coil base configured to be wrapped around at least a portion of a bundled cord; an s-loop including a first loop and a second loop; the first loop coupled to the first end of the helical coil base, the first loop defining a first aperture, the first loop configured to be opened to receive a first end of the bundled cord, such that, the first end of the bundled cord is securely disposed through the first aperture; the second loop coupled to the first loop and defining a second aperture; and a post coupled to the first end of the helical coil base and extending from the helical coil base, such that, the post is configured to be inserted into the second aperture to secure the first loop in a closed position and released from the second aperture to allow the first loop to achieve an open position.

In yet another aspect of the present disclosure, the cord management device includes: a unitary strand of flexible material configured to be formed in a predetermined shape, the unitary strand of flexible material including a first portion and a second portion; the first portion including a first end and a second end, the first portion formed in a helical coil shape including one or more turns in a first direction; the second portion formed in an s-loop shape, the s-loop shape including a first loop and a second loop, the first loop coupled to the first end of the first portion and rotated in a second direction opposite to the first direction, such that, the first loop is disposed adjacent to the first portion, the second loop coupled to the first loop and rotated in the first direction; and a post coupled to the first end of the first portion, the post extending from the first end of the first portion, such that, the post may be inserted into the second loop to secure the first loop in a closed position.

BRIEF DESCRIPTION OF THE DRAWINGS

The above and other aspects, features, and advantages of the present disclosure will become more apparent in light of the following detailed description when taken in conjunction with the accompanying drawings in which.

It should be understood that the drawings are for purposes of illustrating the concepts of the disclosure and are not necessarily the only possible configuration for illustrating the disclosure.

DETAILED DESCRIPTION

Embodiments of the present disclosure will be described herein below with reference to the accompanying drawings. In the following description, well-known functions or constructions are not described in detail to avoid obscuring the present disclosure in unnecessary detail.

The present disclosure is directed to a flexible helical cord management device. The flexible helical cord management device of the present disclosure includes an s-loop and a helical coil base. The s-loop is configured to secure the flexible helical cord management device to an end of a cord, even while the cord is in use. The helical coil base is configured to be wrapped around a portion of the cord after the cord has been bundled, such that, an initial ordered state of the bundled cord is maintained and the cord is prevented from becoming tangled.

Figure 1:
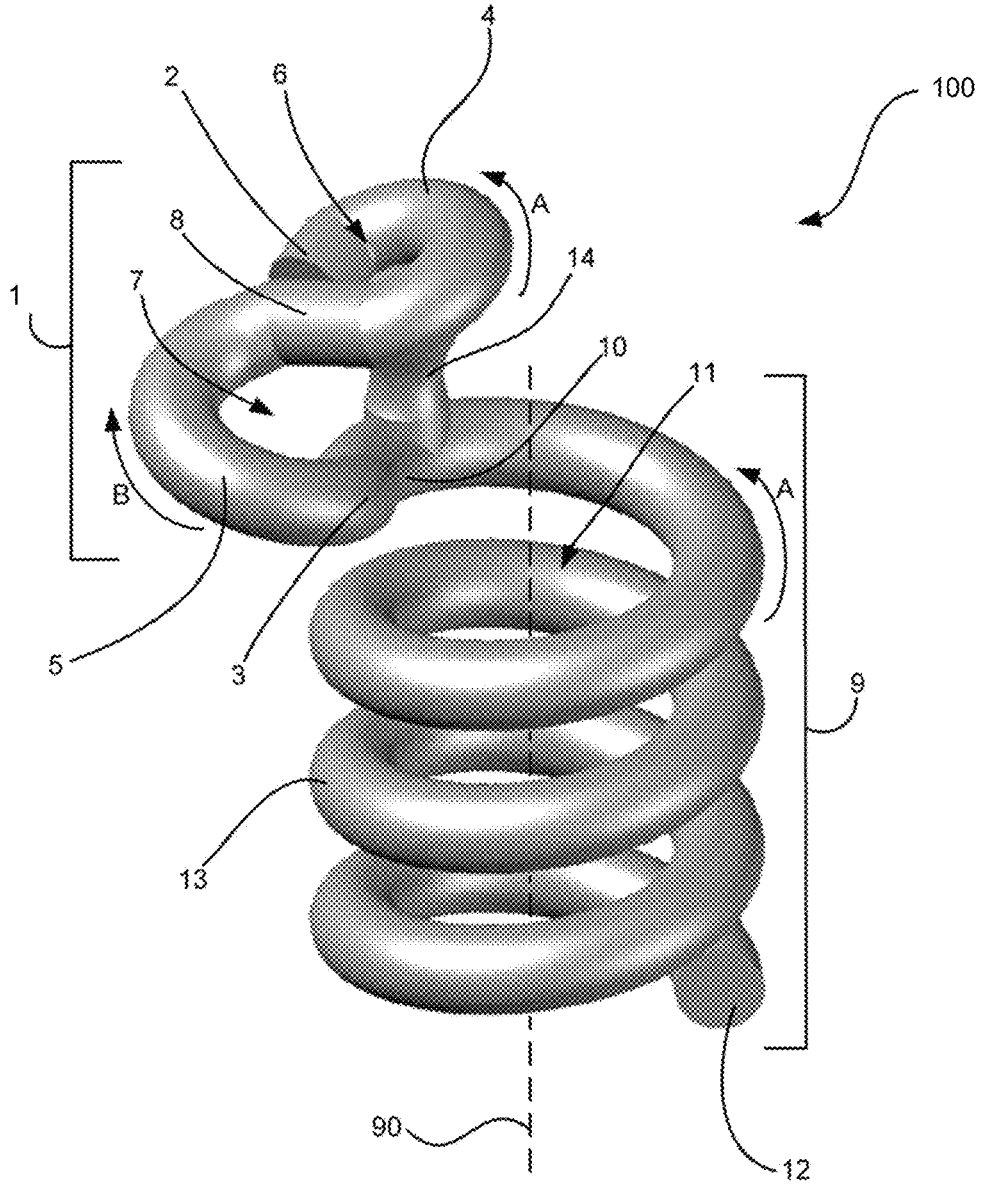
FIG. 1 is a perspective view of a cord management device in accordance with an embodiment of the present disclosure.
Figure 1A:
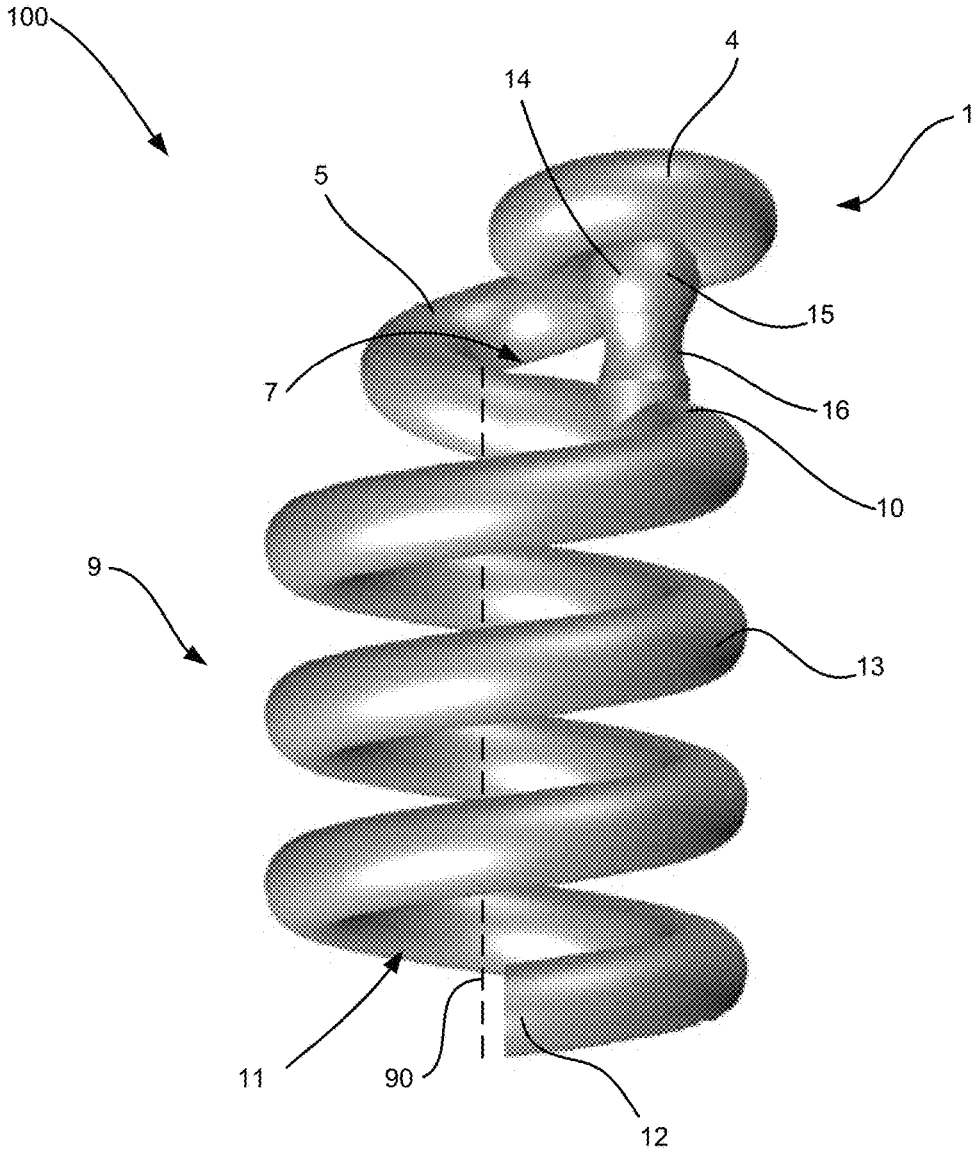
FIG. 1A is a side view of the cord management device of FIG. 1 in accordance with an embodiment of the present disclosure.
Figure 2:
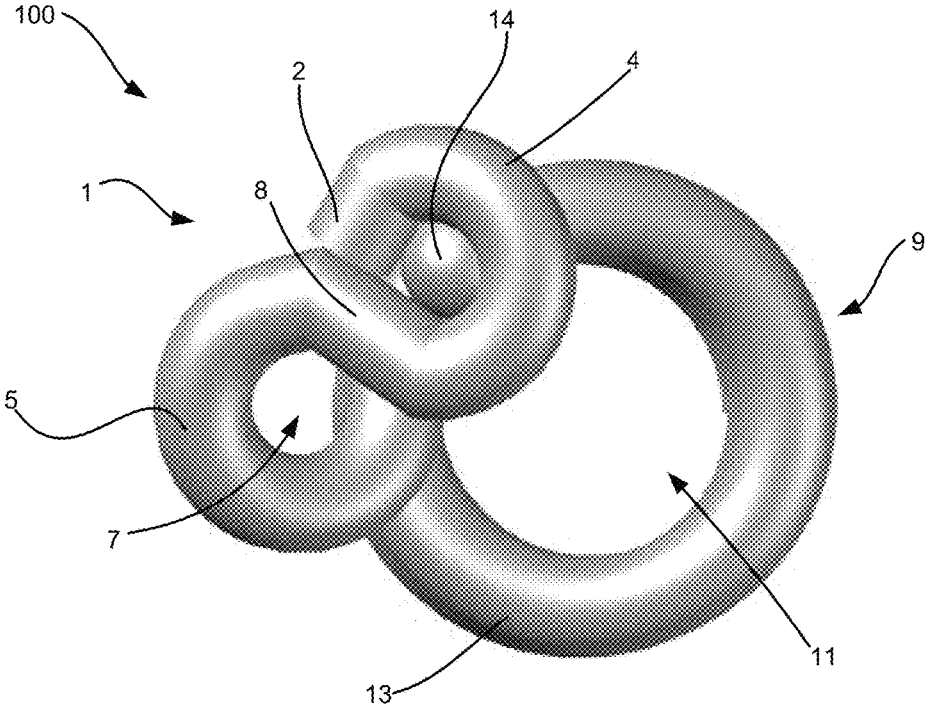
FIG. 2 is a top view of the cord management device of FIG. 1 in accordance with an embodiment of the present disclosure.

Referring to FIGS. 1, 1A, and 2, a flexible helical cord management device 100 is shown in accordance with an embodiment of the present disclosure. FIG. 1 is a perspective view of device 100, FIG. 1A is a side view of device 100, and FIG. 2 is a top view (i.e., through ends 2 and 10 of s-loop 1 and base 9, respectively) of device 100.

Device 100 includes an s-loop 1, a helical base 9, and a post 14. S-loop 1 includes ends 2 and 3, and a mid-point 8 disposed therebetween. S-loop 1 also includes a first loop or turn 4 and a second loop or turn 5. Loop 4 begins from end 2 of s-loop 1 and ends at mid-point 8 of s-loop 1. Loop 4 defines an aperture 6. Loop 5 begins from mid-point 8 of s-loop 1 and ends at end 3 of s-loop 1. Loop 5 defines aperture 7. Base 9 includes ends 10 and 12, where end 3 of s-loop 1 is coupled to end 10 of base 9. As shown in FIGS. 1 and 1A, base 9 is configured in a coiled or helical shape having one or more loops or turns 13 about an axis 90. The loops 13 of helical base 9 define a passageway 11 extending along axis 90 from ends 10 of base 9 to end 12 of base 9. A post 14 is coupled to and extends from end 10 of base 9 in a direction toward aperture 6.

Device 100 is made of a relatively light and elastic or flexible material having a default state (i.e., its resting or undisturbed state) in the shape shown in FIGS. 1, 1A, and 2. For example, base 9 is formed in a helical coil shape, such that, base 9 includes one or more turns or loops 13 of the flexible material about an axis 90 in a direction A (e.g., counterclockwise). At end 10 of base 9 and end 3 of s-loop 1, the flexible material is looped once in a direction B, opposite to direction A (e.g., clockwise), until a mid-point 8 in the s-loop, to create loop 5. At mid-point 8, the flexible material is looped again in the same direction A as base 9, until end 2 is disposed adjacent to mid-point 8, to create loop 4. As shown in FIGS. 1 and 2, since loop 5 is created by looping or turning the flexible material in an opposite direction B to the direction A of base 9, loop 5 is disposed adjacent to base 9, such that, loop 5 is not coaxial with base 9.

In one embodiment, s-loop 1 and base 5 are formed from a unitary strand of a suitable flexible or elastic material. In another embodiment, s-loop 1 and base 9 are separately formed and joined by a suitable means at end 3 of s-loop 1 and end 10 of base 9. The flexible or elastic material may be an elastomer, such as, but not limited to, a thermoplastic elastomer (TPE) or a thermoplastic polyurethane (TPU). The flexible material may be formed into the default state of device 100 through one or more of the following methods: nylon selective laser sintering (SLS), 3D-printing (e.g., using TPU or TPE, or injection molding. It is to be appreciated that the above-included methods and materials are merely exemplary and that any suitable flexible material and method of creating the flexible material that may be used to create device 100 is within the scope of the present disclosure.

Figure 3:
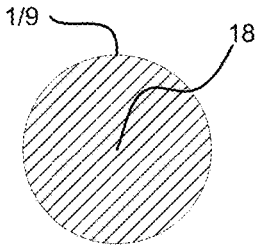
FIG. 3 is a cross-section view of the cord management device of FIG. 1 in accordance with an embodiment of the present disclosure.

As shown in FIGS. 1, 1A, and 2, the exterior surfaces of s-loop 1 and base 9 are each configured in a substantially circular shape. Referring to FIG. 3, a cross-section of base 9 and/or s-loop 1 is shown in accordance with an embodiment of the present disclosure. It is to be appreciated that the cross-section shown in FIG. 3 may represent either a cross-section of base 9 or s-loop 1, as both base 9 and s-loop 1 have identical cross-sections. As seen in FIG. 3, the cross-section of base 9 and/or s-loop 1 illustrates the substantially circular shape of the exteriors of base 9 and s-loop 1.

Figure 2A:
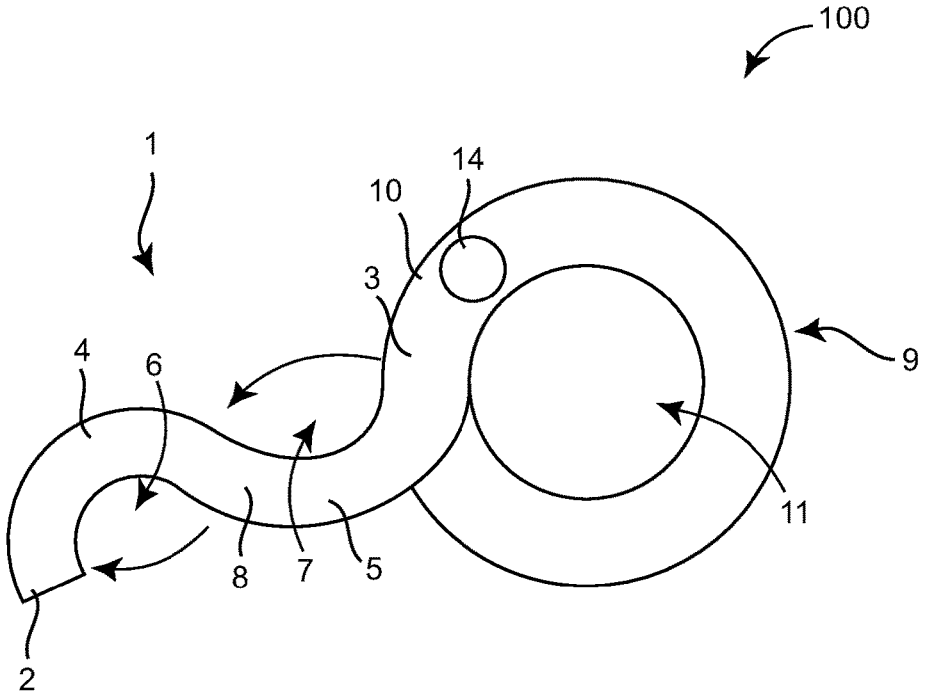
FIG. 2A is a top view of the cord management device of FIG. 1 with an s-loop portion of the device in a stretched, open position in accordance with an embodiment of the present disclosure.

The flexible material used to make device 100 is configured to be sufficiently flexible to permit loops 4 and 5 to be opened and for base 9 to be unwrapped, while being sufficiently rigid to substantially return to the default state of device 100 shown in FIGS. 1, 1A, and 2 after loops 4, 5 and/or base 9 have been altered or stretched from each of their default states. For example, referring to FIG. 2A, a top view of device 100 is shown in accordance with the present disclosure. As shown in FIG. 2A, the flexible material of device 100 enables loop 4 to be opened by displacing or pulling end 2 of loop 4 in a direction away from mid-point 8 of s-loop 1. When loop 4 is released, the material is configured with sufficient rigidity to return to its default state, where end 2 of loop 4 is disposed adjacent to mid-point 8 and aperture 6 is formed again. Also, the flexible material enables loop 5 to be opened by displacing or pulling mid-point 8 of s-loop 1 in a direction away from end 3 of s-loop 1. When loop 5 is released, the material is configured with sufficient rigidity to return to its default state, where, as seen in FIG. 2, mid-point 8 crosses over end 3 of s-loop 1 and end 10 of base 9 and aperture 7 is formed again. It is to be appreciated that base 9 is shown unwrapped or stretched from its default state in FIGS. 5 and 5A, which will be described in greater detail below.

Figure 3A:
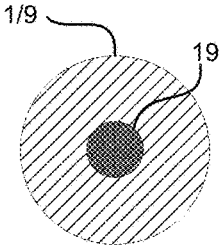
FIG. 3A is a cross-section view of the cord management device of FIG. 1 including a rod embedded in the device in accordance with an embodiment of the present disclosure.

As shown in FIG. 3, in one embodiment, the interior of both s-loop 1 and base 9 is solid (i.e., filled entirely with the flexible material of device 100). Referring to FIG. 3A, in another embodiment, a metallic rod 19 may be embedded within s-loop 1 and base 9, such that, the metallic rod 19 is disposed through a central point 18 of the interior of s-loop 1 and base 9 and extends from end 2 of s-loop 1 to end 12 of base 9. The metallic rod 19 disposed through central point 18 is configured in the default shapes of s-loop 1 and base 9 (as described above) and is sufficiently elastic or flexible to allow s-loop 1 and base 9 to be opened and stretched, while providing additional rigidity to s-loop 1 and base 9 to return s-loop 1 and base 9 to their default states. It is to be appreciated that the thickness of rod 19 may be increased or decreased to increase or decrease the rigidity of device 100.

Figure 3B:
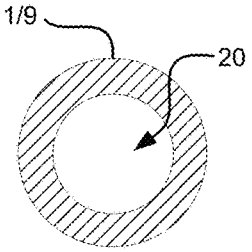
FIG. 3B is a cross-section view of the cord management device of FIG. 1 including a hollow interior in accordance with an embodiment of the present disclosure.

Referring to FIG. 3B, in another embodiment, the material of s-loop 1 and base 9 may include a hollow interior 20 extending from end 2 of s-loop 1 to end 12 of base 9. The hollow interior 20 may be configured to decrease the rigidity (e.g., via removing some of the flexible material) of device 100, as desired. It is to be appreciated that the diameter of the hollow interior 20 may be increased or decreased to increase or decrease the rigidity of device 100.

Referring again to FIGS. 1, 1A and 2, post 14 extends from end 10 of base 9 and is aligned with aperture 6. In one embodiment, post 14 is configured in a generally cylindrical shape. Post 14 includes a tip 15 (i.e., disposed on an end of post 14 that is not coupled to base 9), and a circular recess 16 disposed between tip 15 and the end of post 14 coupled to base 9. In one embodiment, the tip 15 is configured as a substantially spherical tip, having a larger diameter than the diameter of aperture 6 of loop 4. Furthermore, recess 16 is configured with substantially the same diameter as the diameter of aperture 4.

Loop 4 is configured as a clasp that is secured using post 14 to maintain loop 5 in a closed position (i.e., where mid-point 8 crosses end 3 of s-loop 1 to form aperture 7). For example, loop 4 may be pulled or displaced in a direction away from mid-point 8 to open loop 4. After loop 4 has been opened, loop 4 may be lowered toward post 14 and then loop 4 may be released from its opened position and allowed to return to its default shape to wrap around recess 16, such that, post 14 is disposed through loop 4. Once loop 4 is wrapped around recess 16, loop 4 is configured with sufficient rigidity, such that, the inner circumference of loop 4 grips recess 16 of post 14 tightly. Furthermore, since tip 15 is configured with a larger diameter than aperture 6 of loop 4, when post 14 is disposed through aperture 6, the rigidity of loop 4 in the closed position around recess 16 and the larger diameter of tip 15 than aperture 6 together prevent post 14 from sliding out or being removed from aperture 6. While post 14 is disposed through aperture 6, loop 5 is maintained in a closed position (i.e., where mid-point 8 crosses over end 3 of s-loop 1 and end 10 of base 9, such that, aperture 7 is formed). To enable loop 5 to be opened (as shown in FIG. 2A), loop 4 is opened and post 14 is removed from loop 4, such that, loop 5 may be opened.

Figure 4:
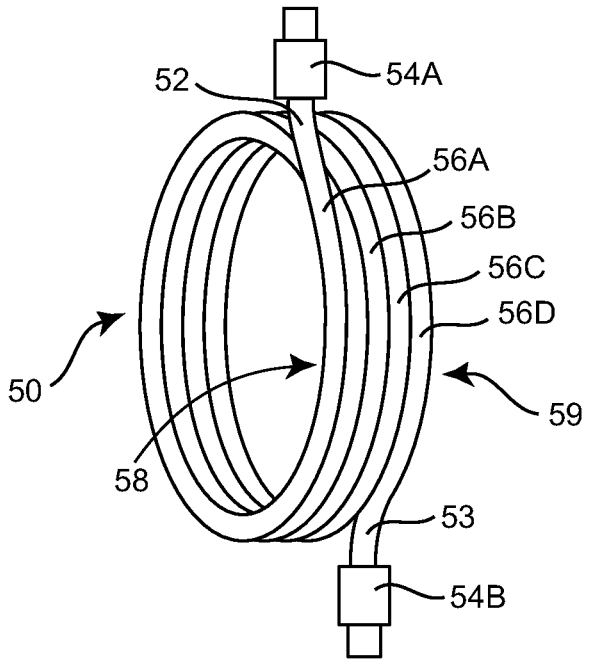
FIG. 4 illustrates a bundled cord in accordance with an embodiment of the present disclosure.

Referring to FIG. 4 an exemplary cord 50 (e.g., a power cord, head phones, extension cord, etc.) is shown in accordance with the present disclosure. As shown in FIG. 4, cord 50 includes ends 52, 53, where each end includes a connector 54 configured to interface with an electronic device. As stated above, in the absence of a cord management device, a user may bundle a cord 50 (e.g., by wrapping it around his/her hands) in a manner shown in FIG. 4 to prevent entanglement of the cord 50 (e.g., in a pocket, purse, lying on the floor with one end plugged into the wall and the other end plugged into a phone charger, etc.). When the cord 50 is initially bundled, the cord 50 will include a plurality of loops or turns 56, such that, the loops or turns 56 are in an ordered and untangled state. For example, cord 50 is shown in a bundled and ordered state in FIG. 4, where a first loop 56A is disposed adjacent to a second loop 56B, the second loop 56B is disposed adjacent to a third loop 56C, etc. As shown in FIG. 4, while cord 50 is in a bundled and ordered state, connector 54A and loop 56A is disposed on side 58 of bundled cord 50 and connector 54B and loop 56D is disposed on side 59 of bundled cord 50.

While bundled cord 50 is in an ordered state, cord 50 is not tangled. However, without the use of a cord management device, the cord 50 may easily become tangled if the ordered state of the loops 56 are not maintained. For example, while bundled cord 50 is moved, compressed, or otherwise disturbed (e.g. within a user's pocket or purse) connector 54A may, after a certain amount of time, become inserted between loops 56C and 56D, such that, connector 54A and loop 56A are no longer disposed on side 58. This process may be repeated several times, where the order of loops 56 is rearranged until the cord 50 becomes tangled and the loops 56 are no longer in an ordered state.

Furthermore, even if a cord management device is used to prevent cord 50 from becoming tangled, if the cord management device is not attached to the cord 50, when the cord management device is not being used, it may easily be lost and need to be subsequently replaced. Furthermore, the cord management device may be bulky and/or susceptible to malfunction if exposed to dirt and other elements (as described above with reference to hook-and-loop fasteners).

The device 100 of the present disclosure is configured to overcome each of the shortcoming described above, while also maintaining cord 50 in an ordered state after cord 50 has been bundled. A method of using device 100 with a cord 50 is described below with reference to FIGS. 4A, 4B, 5, 5A, 6, and 7, in accordance to the present disclosure.

Figure 4A:
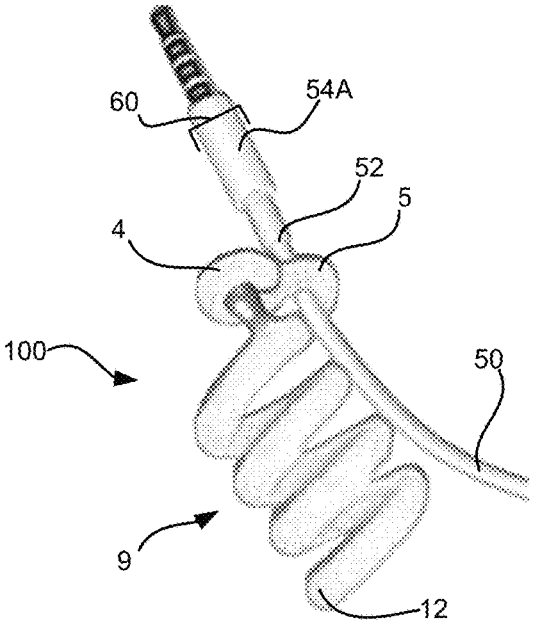
FIGS. 4A and 4B illustrate the cord management device of FIG. 1 secured to an end of a cord in accordance with an embodiment of the present disclosure.
Figure 4B:
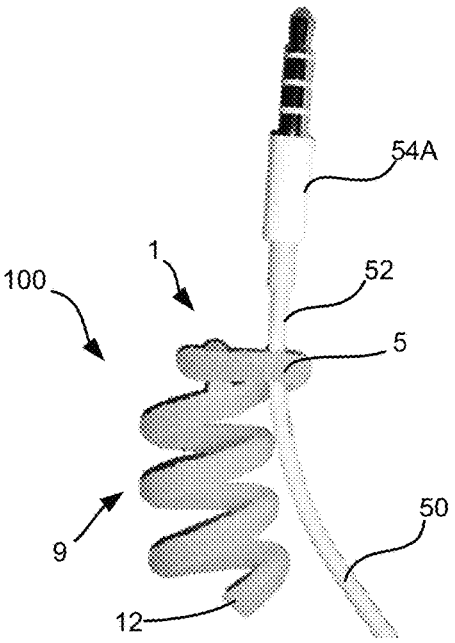

Referring to FIGS. 4A and 4B, initially, while cord 50 is unbundled (i.e., not looped as shown in FIG. 4) end 52 of cord 50 is disposed through aperture 7 of loop 5. To dispose end 52 of cord 50 through aperture 7 of loop 5, loop 5 may be opened (as described above in relation to FIG. 2A) to allow end 52 of cord 50 to be received by loop 5. With end 52 of cord 50 is disposed through aperture 7 of loop 5, loop 5 is released and allowed to return to its default closed position. Then, loop 4 may be opened and secured to post 14, such that, post 14 is disposed through aperture 6 of loop 4 (as described above) to secure loop 5 in the closed position around end 52 of cord 50. In one embodiment, the diameter of aperture 7 is configured to be smaller than the width 60 of connector 54, such that, connectors 54A, 54B cannot pass through aperture 7, while loop 5 is secured in the closed position. In this way, device 100 is prevented from sliding off either end 52, 53 of cord 50. This advantageously, allows device 100 to remain secured to cord 50, while cord 50 is either in-use (i.e., being used to charge a phone, listen to music, etc.) or not in-use and, therefore, preventing device 100 from being lost or misplaced while cord 50 is being used and device 100 is not being used.

It is to be appreciated that, since loop 5 is disposed adjacent to helical coil base 9, when device 100 is secured to end 52 of cord 5 while cord 50 is in an unbundled state (i.e., unwrapped or uncoiled), base 9 does not substantially stick out in a direction away from cord 50. For example, as seen in FIG. 4A, base 9 is enabled to be disposed substantially adjacent to cord 50 because loop 5 is disposed adjacent to base 9. This decreases any interference that may be experienced by having device 100 coupled to cord 50 while cord 50 is in an unbundled state and in use by a user.

Figure 5:
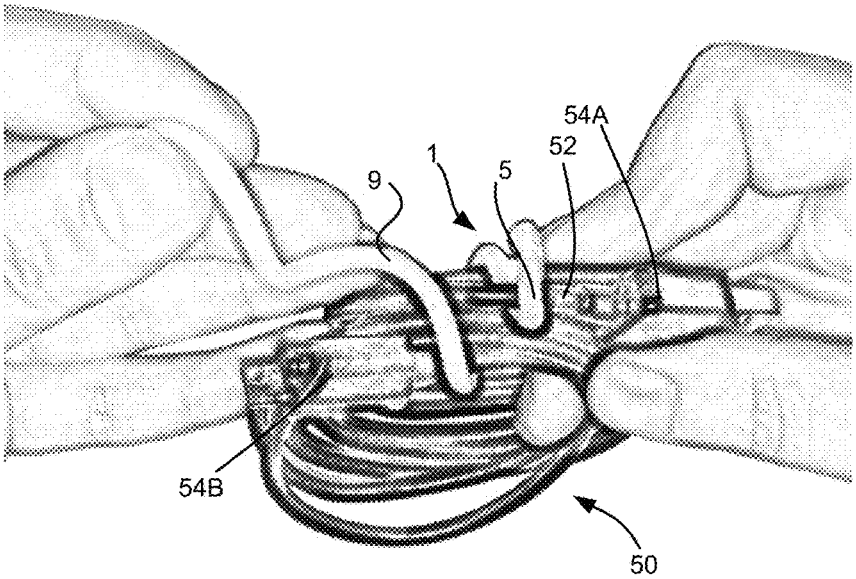
FIGS. 5 and 5A illustrate of the cord management device of FIG. 1 being wrapped around a portion of a bundled cord in accordance with an embodiment of the present disclosure.
Figure 5A:
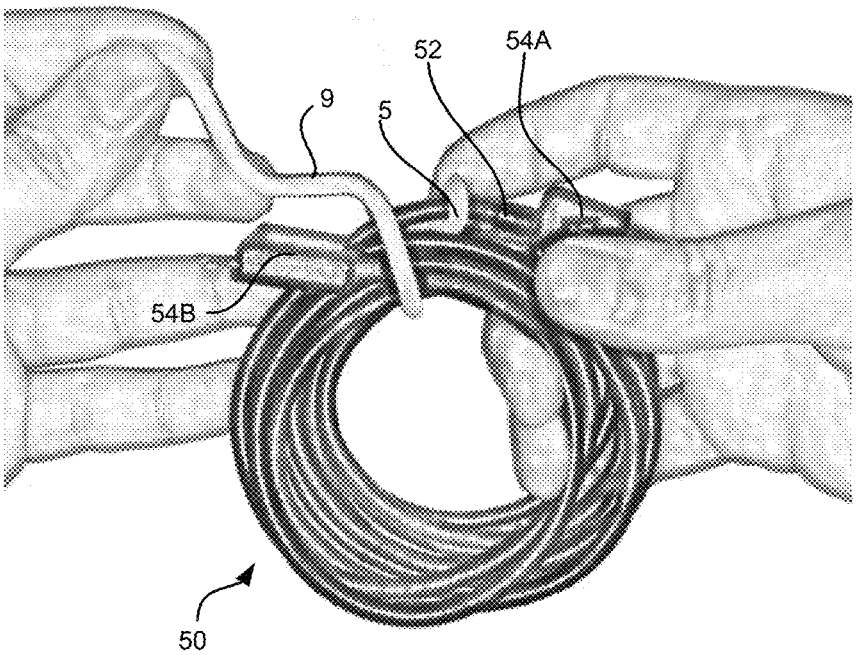
Figure 6:
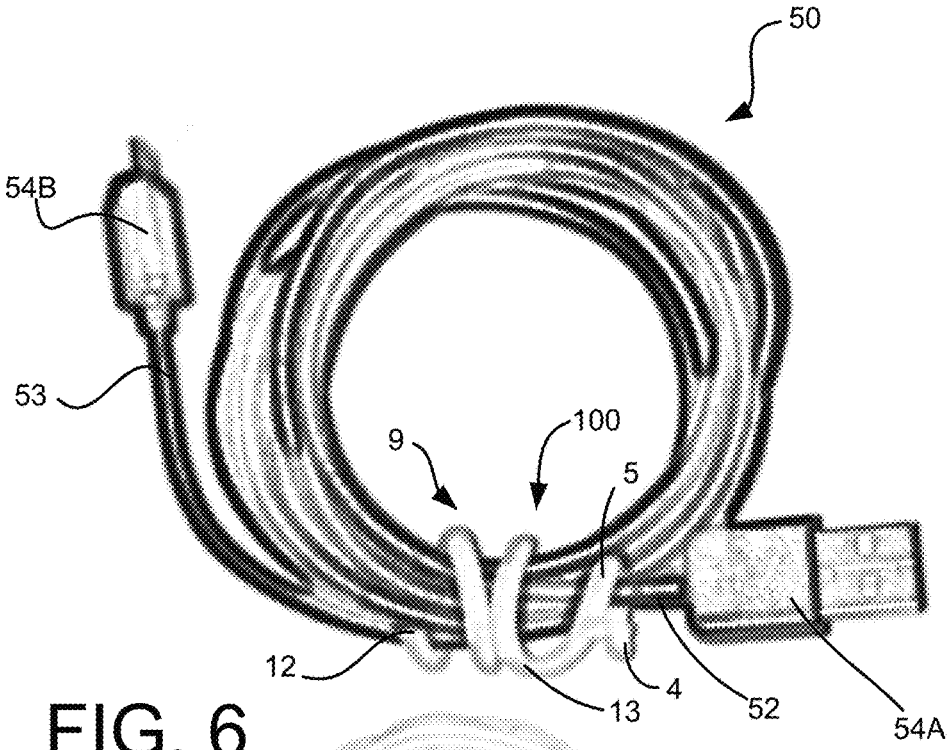
FIGS. 6 and 6A is a side view of the cord management device of FIG. 1 secured to bundled cords of different sizes in accordance with an embodiment of the present disclosure.
Figure 6A:
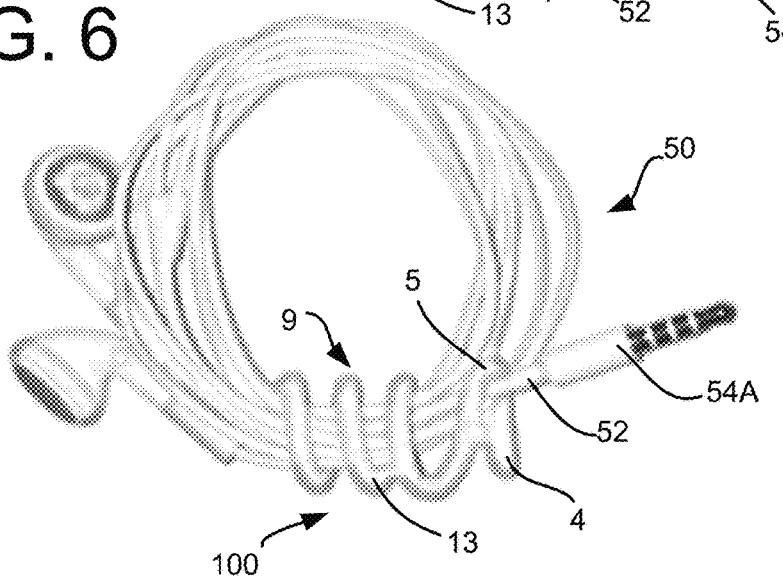

When a user desires to bundle the cord 50, the cord 50 may be bundled (in a manner shown in FIG. 4) into an initial ordered state while loop 5 of device 100 is still secured to end 52 of cord 50. Referring to FIGS. 5 and 5A, while the loop 5 is secured to end 52 of cord 50, base 9 is stretched from its default helical coil shape and wrapped around a portion of bundled cord 50, such that each of the turns 56 of cord 50 are disposed through passageway 11 of base 9. Referring to FIGS. 6, and 6A, base 9 is shown wrapped around different types of cords 50, including different thicknesses and different connectors 54. The material of base 9 is configured, such that, after base 9 is wrapped around a portion of bundled cord 50, base 9 retains its default state (i.e., the helical coil shape) around cord 50, such that, each of the turns 13 of base 9 grip the portion of the bundled cord 50 that base 9 is wrapped around to maintain bundled cord 50 in an ordered state.

The flexibility of base 9 enables base 9 to be wrapped around bundled cords 50 having various number of loops 56 (e.g., when bound more or less tightly) of cord 50 and/or having various thickness. The flexibility of base 9 enables the diameter of passageway 11 to adjust as needed based on the thickness and number of turns 56 of bundled cord 50 that are to be disposed through passageway 11. As the diameter of passageway 11 is increased, the number of turns 13 of base 9 around bundled cord 50 is decreased. For example, as shown in FIGS. 6 and 6A, base 9 is wrapped around a thicker bundled cord 50 in FIG. 6 than in FIG. 6A. When wrapped around the thicker cord shown in FIG. 6A, the diameter of passageway 11 is increased or stretched, such that, base 9 includes 2 turns. Alternatively, when wrapped around a thinner bundled cord 50 in FIG. 6A, the diameter of passageway 11 is sufficient to accommodate the thinner bundled cord 50, therefore, the base 9 retains the 3 turns 13 that are present while base 9 is in the default state (shown in FIGS. 1, 1A, and 2). Furthermore, as described below, device 100 may be configured in different sizes with different dimensions and additional turns 13 to accommodate cords of different sizes.

Figure 7:
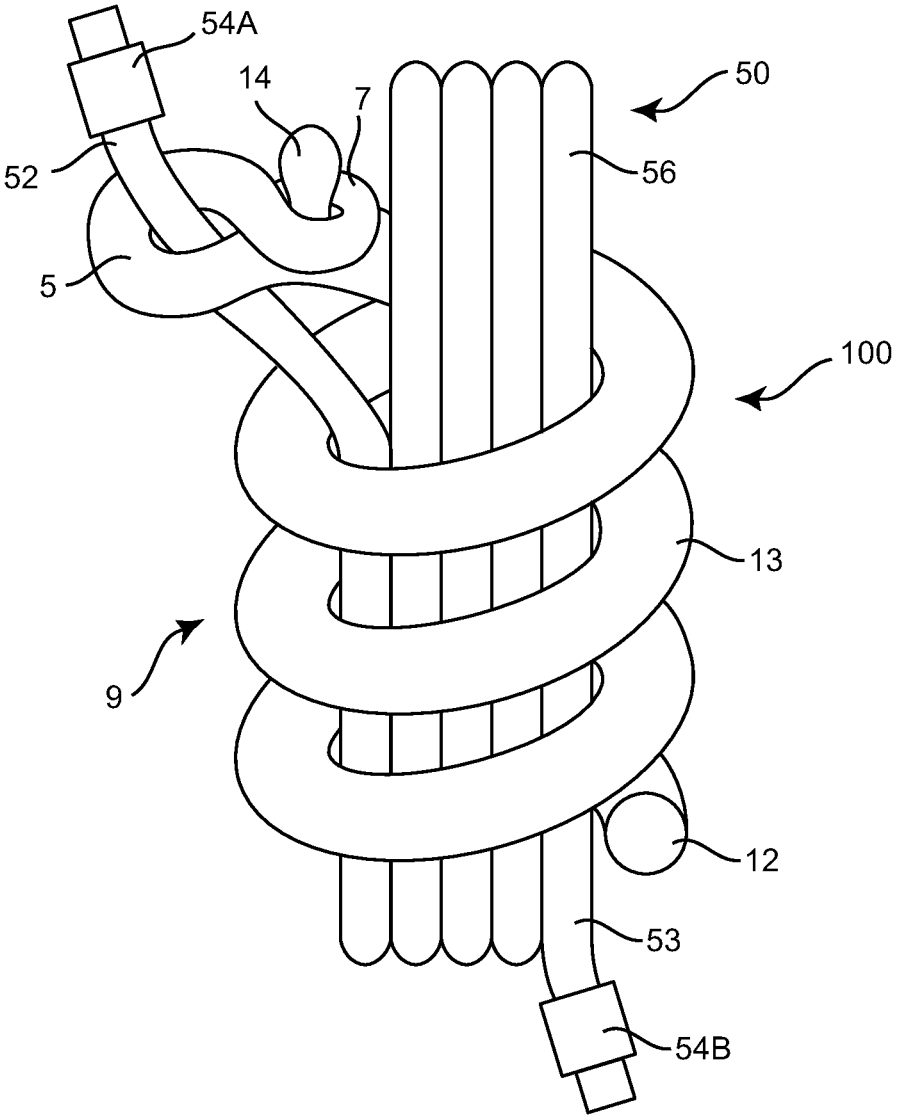
FIG. 7 is a perspective view of the cord management device of FIG. 1 secured to a bundled cord in accordance with an embodiment of the present disclosure.

As shown in FIGS. 6 and 6A, while loop 5 coupled to end 52 of cord 50 and base 9 coiled around a portion of cord 50, device 100 is configured to maintain cord 50 in an ordered state, as described above. Referring to FIG. 7, a front view of device 100 secured to a bundled cord 50 is shown in accordance with the present disclosure. In FIG. 7, it is clearly shown that the turns 13 of base 9 grip bundled cord 50, such that, the ordered state of each of the turns 56 of cord 50 is maintained and cord 50 is prevented from becoming tangled. It is to be appreciated, that base 9 is configured with sufficient rigidity, such that, while wrapped around bundled cord 50, the ordered state of bundled cord 50 is maintained. Furthermore, since loop 5 is disposed adjacent to base 9, end 52 and connector 54A is maintained on side 58 (shown in FIG. 4) of bundled cord 50, and prevented from being inserted between any other turns 56 of cord 50. In this way, each of s-loop 1 and base 9 are together configured to maintain cord 50 in an ordered state.

The design and flexible or elastic material of device 100 enable device 100 to be relatively small and light-weight compared to the cords 50 that device 100 is used in conjunction with. Base 9 of device 100 can easily and efficiently be wrapped and unwrapped around a bundled cord 50 without ever having to decouple device 100 from cord 50. Furthermore, since device 100 does not employ mechanisms, such as, hook-and-loop fasteners, device 100 is not susceptible to malfunction with the introduction of elements, such as, mud, dust, and/or dirt. In this way, device 100 may be used repeatedly with the same cord or various different cords in an easy and efficient manner without being lost or misplaced to prevent a cord 50 from becoming tangled and/or pinched.

It is to be appreciated that the number of turns 13 included in base 9 and the dimensions of devices 100 (i.e., the diameters of apertures 6, 7, and passageway 11, and the length of the unitary strand of flexible material comprising s-loop 1 and base 9) relative to cords 50 shown in FIGS. 4, 4A, 4B, 5, 5A, 6, 6A, and 7 and described herein are merely exemplary and that other dimensions and configurations of device 100 are considered to be within the scope of the present disclosure. For example, device 100 may be configured with additional turns 13 and/or the diameter of aperture 7 may be increased (as described below), such that, device 100 may be used to secure larger and/or thicker cords 50 in a bundled state.

Figure 8:
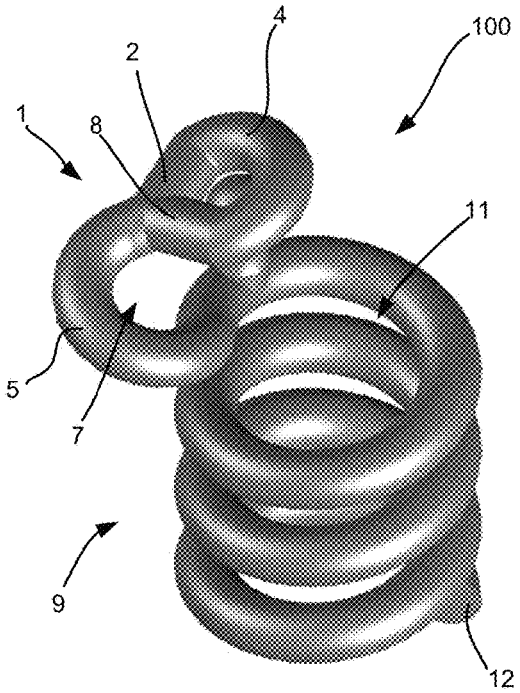
FIG. 8 is a perspective view of the cord management device of FIG. 1 with a closed loop clasp in accordance with an embodiment of the present disclosure.
Figure 8A:
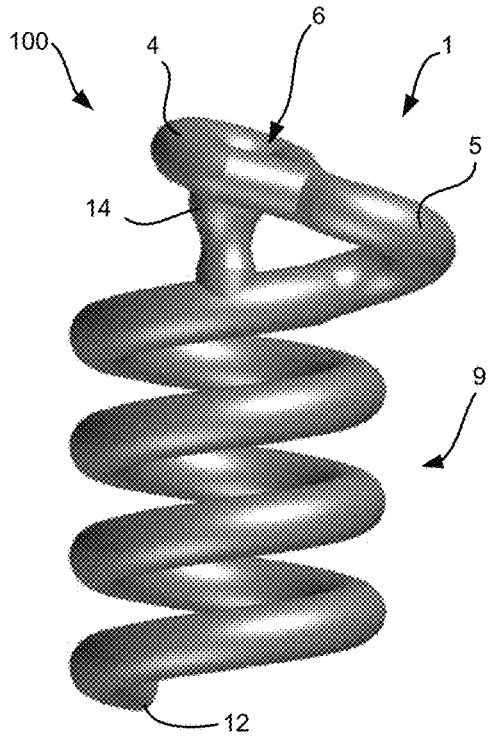
FIG. 8A is a side view of the cord management device of FIG. 8 in accordance with an embodiment of the present disclosure.
Figure 9:
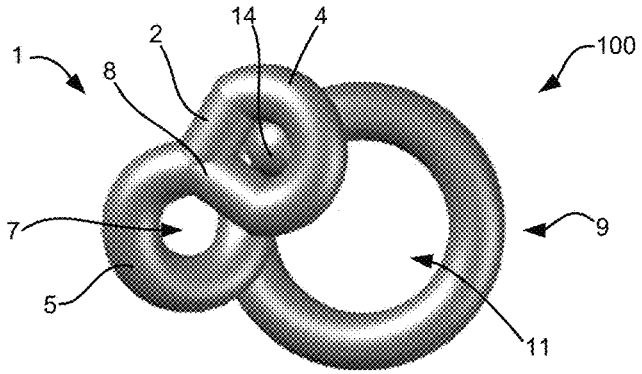
FIG. 9 is a top view of the cord management device of FIG. 8 in accordance with an embodiment of the present disclosure.

Although above, loop 4 is described as being "open" (i.e., where end 2 of loop 4 is not otherwise fixedly coupled to device 100), such that loop 4 can be opened as shown in FIG. 2A, in another embodiment loop 4 may be configured as a "closed" loop. For example, referring to FIGS. 8, 8A, and 9, device 100 is shown, where end 2 of s-loop 1 is fixedly coupled to mid-point 8 to form a closed loop clasp 4 in accordance with an embodiment of the present disclosure. As shown in FIGS. 8, 8A, and 9, when end 2 is fixedly coupled to mid-point 8, loop 4 becomes a closed loop. The closed loop 4 is configured to provide increased resistance against loop 5 being opened when post 14 is disposed through aperture 6 of loop 4. As described above, tip 15 of post 14 is configured with a larger diameter than aperture 6 of loop 4. In this embodiment, loop 4 and/or tip 15 of post 14 are configured to deform slightly when post 14 is inserted into aperture 6 of loop 4, to allow the smaller diameter of aperture 6 to accept tip 15 as tip 15 is disposed through aperture 6.

Although the exterior surfaces of base 9 and s-loop 1, respectively, of device 100 are configured as generally circular shapes (as shown in FIGS. 1, 1A, 2, and 3) in the embodiments described above, in other embodiments, the exterior surfaces of base 9 and s-loop 1 may be configured as other shapes in accordance with the present disclosure to increase rigidity.

Figure 10:
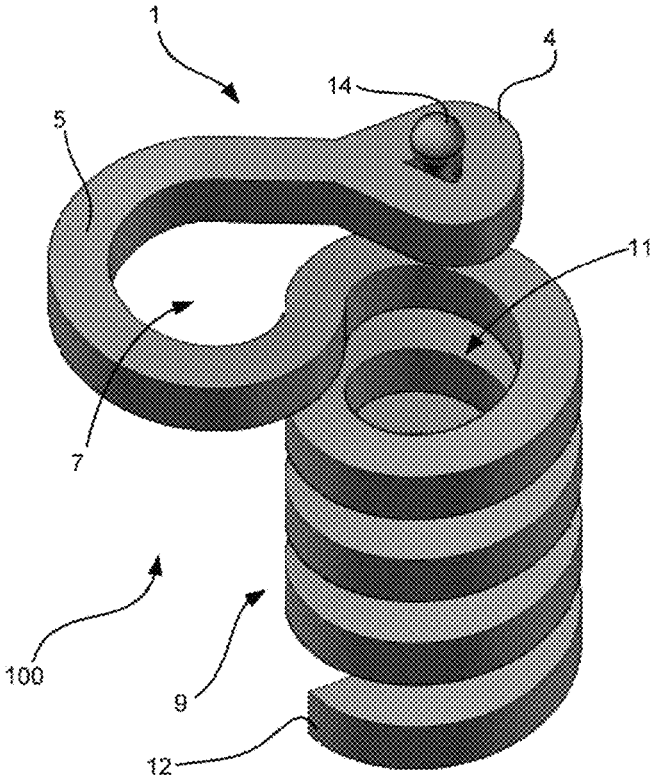
FIG. 10 is a perspective of yet another cord management device in accordance with an embodiment of the present disclosure.
Figure 12:
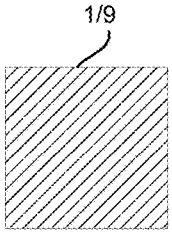
FIG. 12 is a cross-section view of the cord management device of FIG. 10, where the exterior surface of the cord management device is configured in a substantially square shape in accordance with an embodiment of the present disclosure.
Figure 13:
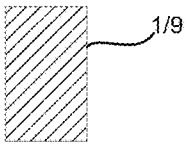
FIG. 13 is a cross-section view of the cord management device of FIG. 10, where the exterior surface of the cord management device is configured in a substantially square rectangular shape in accordance with an embodiment of the present disclosure.
Figure 11:
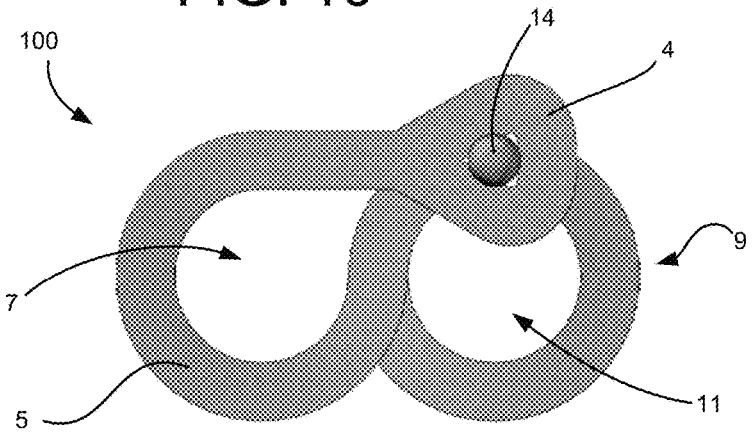
FIG. 11 is a top view of the cord management device of FIG. 10 in accordance with an embodiment of the present disclosure.

For example, referring to FIGS. 10 and 11, device 100 is shown, where the exterior surfaces of base 9 and s-loop 1, respectively, are configured as square or rectangular shapes. Referring to FIG. 12, a cross-section of s-loop 1 and/or base 9 of the embodiment of device 100 shown in FIGS. 10 and 11 is shown in accordance with the present disclosure. As shown in FIG. 12, in one embodiment, the exterior surfaces of s-loop 1 and base 9, respectively, may be configured in a substantially square shape. Referring to FIG. 13, a cross-section of s-loop 1 and/or base 9 of the embodiment of device 100 shown in FIGS. 10 and 11 is shown in accordance with the present disclosure. As shown in FIG. 13, in another embodiment, the exterior surfaces of s-loop 1 and base 9, respectively, may be configured in a substantially rectangular shape. The square and rectangular shapes shown in FIGS. 10-13 are configured to provide additional rigidity to both s-loop 1 and base 9 to secure thicker or more heavy duty cords, (e.g., extension cords, cords for high-voltage devices, etc.) using device 100.

It is to be appreciated that aperture 7 may be configured with a larger diameter to accommodate thicker cords. For example, in FIG. 11, aperture 7 of loop 5 is shown configured with a larger diameter to accommodate thicker cords.

It is to be appreciated that the embodiment of device 100 shown in FIGS. 10 and 11 include a closed loop clasp 4, as described above in reference to FIGS. 8, 8A, and 9. However, the embodiment of device 100 shown in FIGS. 10 and 11 may also be configured with an open loop clasp 4, as described above in reference to FIGS. 1, 1A, 2, and 2A. Furthermore, the embodiment of device 100 shown in FIGS. 10 and 11 may include a metallic rod 19 (as described above in reference to FIG. 3A) embedded within s-loop 1 and base 9 and extending from end 12 of base 9 to closed loop clasp 4 to add additional rigidity to device 100. The embodiment of device 100 shown in FIGS. 10 and 11 may include a hollow interior 20 (as described above in reference to FIG. 3B) embedded within s-loop 1 and base 9 and extending from end 12 of base 9 to closed loop clasp 4 to decrease the rigidity to device 100.

Although each of the embodiments above have included a single s-loop 1 coupled to an end 10 of helical coil 9, in another embodiment of the present disclosure, a second s-loop may be coupled to end 12 of helical 9. The second s-loop may be secured to the other end 53 of cord 50, such that, an s-loop of device 100 is secured to each of ends 52, 53 of cord 50. The second s-loop is configured to further maintain the ordered state of a bundled cord 50.

It is to be appreciated that the flexible material used to make device 100 may be configured as a slip resistant material, having a high coefficient of friction while also being in accordance with industry electrical cord management standards. In another embodiment, the exterior surfaces s-loop 1 and base 9 may be coated with the slip resistant material. In either case, with the addition of the slip resistant material, when base 9 is wrapped around a portion of bundled cord 50, the inner surfaces of each turn or loop 13 of base 9 grip the bundled cord 50 in a more effective manner, preventing the bundled cord 50 from sliding while being gripped by base 9. Furthermore, when end 52 of cord 50 is disposed through aperture 7 of loop 5, the inner surface of loop 5 grips end 52 of cord 50 in a more effective manner, greatly reducing the ability for cord 50 to slide through aperture 7.

It is to be appreciated that the various features shown and described are interchangeable, that is a feature shown in one embodiment may be incorporated into another embodiment.

While the disclosure has been shown and described with reference to certain preferred embodiments thereof, it will be understood by those skilled in the art that various changes in form and detail may be made therein without departing from the spirit and scope of the disclosure.

Furthermore, although the foregoing text sets forth a detailed description of numerous embodiments, it should be understood that the legal scope of the invention is defined by the words of the claims set forth at the end of this patent. The detailed description is to be construed as exemplary only and does not describe every possible embodiment, as describing every possible embodiment would be impractical, if not impossible. One could implement numerous alternate embodiments, using either current technology or technology developed after the filing date of this patent, which would still fall within the scope of the claims.

It should also be understood that, unless a term is expressly defined in this patent using the sentence "As used herein, the term '_____' is hereby defined to mean . . . " or a similar sentence, there is no intent to limit the meaning of that term, either expressly or by implication, beyond its plain or ordinary meaning, and such term should not be interpreted to be limited in scope based on any statement made in any section of this patent (other than the language of the claims). To the extent that any term recited in the claims at the end of this patent is referred to in this patent in a manner consistent with a single meaning, that is done for sake of clarity only so as to not confuse the reader, and it is not intended that such claim term be limited, by implication or otherwise, to that single meaning. Finally, unless a claim element is defined by reciting the word "means" and a function without the recital of any structure, it is not intended that the scope of any claim element be interpreted based on the application of 35 U.S.C. § 112, sixth paragraph.

What is claimed is:

1. A cord management device, comprising:

a helical coil base including a first end and a second end, the helical coil base configured to be wrapped around at least a portion of a bundled cord;

a first loop coupled to the first end of the helical coil base, the first loop defining a first aperture, the first loop configured to be opened to receive a first end of the bundled cord, such that, the first end of the bundled cord is securely disposed through the first aperture;

a second loop coupled to the first loop; and a securing member configured to secure the second loop to the helical coil base to secure the first loop in a closed position.

2. The cord management device of claim 1, wherein the second loop defines a second aperture and the securing member is configured as a post, the post being coupled to the first end of the helical coil base and extending from the helical coil base in a direction toward the second aperture, the post configured to be disposed through the second aperture to secure the first loop in the closed position.

3. The cord management device of claim 2, wherein the post includes an end that is not coupled to the helical coil base, the end of the post including a tip configured to be larger than the aperture of the second loop, such that, when the post is disposed through the second aperture, the tip of the post prevents the post from being removed from the second aperture.

4. The cord management device of claim 3, wherein the post includes a recess configured with substantially the same diameter as the aperture of the second loop, the recess configured to receive the second loop when the post is disposed through the second aperture.

5. The cord management device of claim 4, wherein the second loop is configured as a closed loop.

6. The cord management device of claim 4, wherein the second loop is configured to be opened to receive the post.

7. The cord management device of claim 2, wherein the post is configured to be released from the second aperture to allow the first loop to achieve an open position.

8. The cord management device of claim 1, wherein the first end of the bundled cord includes a connector and the first aperture of the first loop is configured with a sufficiently small diameter, such that, the connector cannot pass through the first aperture while the first loop is in the closed position.

9. The cord management device of claim 1, wherein the helical coil base includes a passageway and the first loop is disposed adjacent to the helical coil base, such that, the passageway and the first aperture are not coaxial.

10. The cord management device of claim 1, wherein the helical coil base is configured in a helical shape and is made of a material configured to be sufficiently flexible to enable the helical coil base to be stretched and wrapped around the at least a portion of the bundled cord, the flexible material being sufficiently rigid to return the helical coil base to the helical shape after the helical coil base has been stretched.

11. The cord management device of claim 1, wherein the first loop and the second loop are made of a material configured to be sufficiently flexible to enable the first loop and the second loop to be opened, the material being sufficiently rigid to return the first loop and the second loop to a closed position after being opened.

12. The cord management device of claim 1, wherein the first loop, the second loop, and the helical coil are made of a thermoplastic elastomer.

13. The cord management device of claim 1, wherein the first loop, the second loop, and the helical coil base each include exterior surfaces and each of the exterior surfaces are configured in a substantially circular shape.

14. The cord management device of claim 1, wherein the first loop, the second loop, and the helical coil base each include exterior surfaces and each of the exterior surfaces are configured in a substantially rectangular shape.

15. The cord management device of claim 1, further comprising a flexible rod embedded within the helical coil base and extending from the first end of the helical coil base to the second end of the helical coil base, the rod configured to increase the rigidity of the helical coil base.

16. The cord management device of claim 1, wherein the bundled cord includes a plurality of turns arranged in an ordered state, and the helical coil base and the first loop are configured to substantially maintain the plurality of turns in the ordered state when the helical coil based is wrapped around the at least a portion of the bundled cord and the first end of the bundled cord is disposed through the first aperture.

17. The cord management device of claim 1, wherein the helical coil base, the first loop, and the second loop comprise a unitary strand of flexible material formed in a predetermined shape.

18. The cord management device of claim 1, wherein when the helical coil base is unwrapped from the at least a portion of the bundled cord, the first loop is configured to remain secured to the first end of the bundled cord.

19. A cord management device, comprising:

a helical coil base including a first end and a second end, the helical coil base configured to be wrapped around at least a portion of a bundled cord;

an s-loop including a first loop and a second loop;

the first loop coupled to the first end of the helical coil base, the first loop defining a first aperture, the first loop configured to be opened to receive a first end of the bundled cord, such that, the first end of the bundled cord is securely disposed through the first aperture;

the second loop coupled to the first loop and defining a second aperture; and a post coupled to the first end of the helical coil base and extending from the helical coil base, such that, the post is configured to be inserted into the second aperture to secure the first loop in a closed position and released from the second aperture to allow the first loop to achieve an open position.

20. A cord management device, comprising:

a unitary strand of flexible material configured to be formed in a predetermined shape, the unitary strand of flexible material including a first portion and a second portion;

the first portion including a first end and a second end, the first portion formed in a helical coil shape including one or more turns in a first direction;

the second portion formed in an s-loop shape, the s-loop shape including a first loop and a second loop, the first loop coupled to the first end of the first portion and rotated in a second direction opposite to the first direction, such that, the first loop is disposed adjacent to the first portion, the second loop coupled to the first loop and rotated in the first direction; and a post coupled to the first end of the first portion, the post extending from the first end of the first portion, such that, the post is configured to be inserted into the second loop to secure the first loop in a closed position.

* * * * *